United States Patent [19]

Hirschfeld

[11] 4,346,323

[45] Aug. 24, 1982

[54] INFRARED RADIATION LAMP

[75] Inventor: Tomas Hirschfeld, Livermore, Calif.

[73] Assignee: Technicon Instruments Corporation, Tarrytown, N.Y.

[21] Appl. No.: 75,934

[22] Filed: Sep. 17, 1979

[51] Int. Cl.[3] ..... H01K 1/32

[52] U.S. Cl. ..... 313/111; 313/112; 313/113

[58] Field of Search ..... 313/111, 112, 113

[56] References Cited

U.S. PATENT DOCUMENTS

| | | | |
|---|---|---|---|
| 1,043,008 | 10/1912 | Hoffman | 313/112 |
| 1,239,371 | 9/1917 | Evans | 313/110 |
| 2,859,369 | 11/1958 | Williams et al. | 313/113 |
| 3,188,513 | 6/1965 | Hansler | 313/112 |
| 3,662,208 | 5/1972 | Ohmae et al. | 313/111 X |

*Primary Examiner*—Palmer C. Demeo

[57] ABSTRACT

An incandescent radiation lamp features a novel design which provides for an infrared beam of higher radiance than similar lamps. The higher radiance beam is accomplished by a surrounding reflective screen which internally focuses the generated radiation back upon the bulb filament of the lamp. The focused radiation is then redirected by reflection from the filament, and is emitted from the lamp as an intensified beam through a small window in the surrounding reflective screen.

An added benefit of the new design is the improvement in the thermal efficiency of the lamp, so that less power is required for its operation.

13 Claims, 2 Drawing Figures

INFRARED RADIATION LAMP

FIELD OF THE INVENTION

The invention relates to an incandescent radiation lamp operating in the near infrared to infrared range and, more particularly, to a lamp of improved design which focuses and redirects the radiant energy output of the bulb filament to provide an intensified beam of radiation.

BACKGROUND OF THE INVENTION

Lamps for generating near infrared or infrared radiation find wide application in many analytical instruments such as spectrophotometers, attenuated total reflectance (ATR) spectrophotometers and near infrared diffuse reflectance spectrometers of the kind shown in patent application Ser. No. 15,017, filed: Feb. 26, 1979, assigned to a common assignee.

Incandescent lamps having a tungsten filament bulb are most often used as a source of near infrared radiation in such reflectance analysis instruments. The major drawback in using these incandescent lamps is that the tungsten filament has a very low emissivity in the near infrared range. Therefore, such lamps have poor radiation output. In addition, their visible emission is high contributing undesirable stray light, while increasing power consumption and heat loading for the lamp. In order to compensate for these problems, the lamp is usually operated at a lower filament temperature. However, the lower filament temperature causes a further loss in the radiation output of the lamp.

In order to provide a beam of monochromatic radiation for the near infrared diffuse reflectance spectrometer, the output of the lamp must be further filtered and collimated, thus reducing the intensity of the radiation still further.

Therefore, it would be desirable to produce a lamp for spectrophotometers and similar instruments which can provide a beam of radiation of greater radiance than is presently available using the same or less power consumption.

PRIOR ART

Recently, an energy-saving light bulb has been developed which can provide the same light output using 30% less electrical power. This light bulb features a new design having a dichroic reflective layer on the inside surface of the bulb. The reflective surface allows light to pass through the glass bulb, but focuses the heat (infrared radiation) back to the filament. In the visible light range, the tungsten filament is a good emitter. However, the characteristic of the radiation from an incandescent filament is such that only 10% of the emitted radiation is visible light, with the balance of the emitted energy being primarily infrared. This infrared energy is reflected back to the filament where the focused heat energy is largely absorbed by the filament. This absorbed heat reduces the amount of external energy needed to keep the filament glowing and thus improves the thermal and power consuming efficiency of the lamp. This light bulb is described in U.S. Pat. No. 4,160,929, issued July 10, 1979.

If a standard design incandescent bulb is now used for a lamp operating in the near infrared to infrared range, the tungsten filament will no longer be a good emitter, and will, therefore, be a less efficient radiation source than an equivalent temperature black body. However, it has been discovered that the poor emissivity of the tungsten filament in the near infrared range, which implies good reflectivity, can be used to advantage in conjunction with a surrounding reflector to provide a lamp that can emit a higher intensity of radiation. This is accomplished by using the filament to redirect by reflection, the focused infrared radiation through a window in the surrounding reflective screen. The reflected radiation will emerge from the lamp in the form of an intensified beam. In addition, the thermal efficiency of this lamp will also be improved to the extent that some of the infrared radiation will be absorbed by the filament, thus reducing power consumption and the generation of unwanted visible light.

SUMMARY OF THE INVENTION

This invention pertains to an improved radiation generating lamp, and method for increasing the emitted radiation from the lamp. The lamp operates in the near infrared to infrared range. The lamp comprises an incandescent source of radiation which is substantially surrounded by a reflective means. The reflective means receives radiation emanating from the incandescent source and reflects this radiation back towards the source of radiation. The reflective means has a window through which a portion of generated and reflected radiation may pass. The source is arranged (generally concentrically) within the reflective means to receive and redirect the reflected radiation towards and through the window, whereby a radiation beam of higher intensity will pass through the window. Thus, the radiation emitting characteristics of the lamp will be improved.

It is an object of this invention to provide an improved radiation generating lamp operating in the near infrared to infrared range. For purposes of definition, this range is energy of wavelength approximately from 700 nm to 5,000 nm.

It is another object of the invention to provide a method and apparatus for increasing the radiance of emitted radiation from a radiation generating device operating in the defined range.

It is a further object of this invention to provide a lamp operating in the defined range which will emit a radiation beam of higher intensity having less stray visible light, and consuming less power.

These and other objects of the invention will be better understood and become more apparent with reference to the following detailed description taken in conjunction with the accompanying drawings.

DETAILED DESCRIPTION OF THE INVENTION

Figure 1:
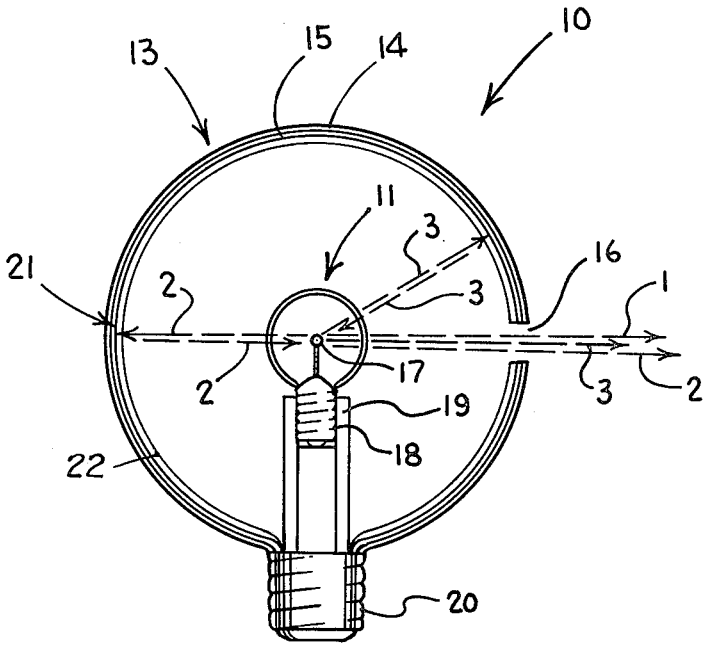
FIG. 1 is a schematic sectional view of one embodiment of the invention.

Referring to FIG. 1, a first embodiment of this invention is shown. The inventive radiation generating lamp is generally depicted in a schematic sectional view by arrow 10. The lamp 10 comprises an incandescent bulb 11 which is made preferably of thin, clear glass to minimize transmissional losses therethrough. At the center of bulb 11 is a filament preferably of tungsten. The bulb 11 is preferably spherical in shape and concentrically centered within a mirrored reflective screen 13. The reflective screen 13 is preferably spherical and comprises a brass shell 14 which has a polished mirror coating 15 of silver or gold on its inner surface. The screen 13 has a window 16 in the side thereof. Window 16 can be a circular portion cut in the brass shell 14.

Bulb 11 can be a standard-type incandescent bulb having a filament of tungsten and a screw-type base 18, which fits in a matching socket 19. The socket 19 can be part of a larger base 20 that extends through screen 13, and which can be connected to a source of power (not shown).

The radiation generating lamp 10 has as its purpose to improve the radiance of the filament source. The term radiance is defined herein as the rate of radiant energy emission per unit of projected area of a source, in a stated angular direction from the surface of the source per unit of solid angle. The term radiance has units of watts per centimeter squared per steradian.

Lamp 10 operates in the range of near infrared to infrared radiation (700 nm to 5,000 nm). The operation of the lamp 10 comprises the focusing of emitted radiation from filament 17 back upon the filament. This is accomplished by means of the mirrored reflective screen 13, which receives a multiplicity of typical rays "3" of infrared radiation and some visible light, which emanate from filament 17 in all directions. The reflective layer 15 of shell 13 will reflect these rays "3" back towards filament 17, as typically shown. Layer 22 may be formed overcoating to selectively absorb radiation of certain wavelengths emitted from filament 17, whereby radiation within a given range of wavelengths is reflected back towards the filament.

In the infrared range, the tungsten filament 17 will have a poor emissivity, which emissivity also indicates that the filament will not readily absorb energy, and therefore, will conversely be a good reflector of energy. The rays "3" which are directed back towards the filament 17 will then be reflected when they impinge upon the filament. After repeated reflections from screen 13 to filament 17 and back again, some of the rays "3" will find their way out of the lamp through the window 16. In other words, the screen 13 has an integrating effect upon the rays "3". Also, some of the rays "2" emanating from filament 17 to the far rear portion 21 of the screen 13, will bounce back to the filament 17, and will pass through the voids or spacing in the spiral filament structure. These rays "2" passing through the filament will then pass out of the lamp via the window 16, as shown.

Rays "1" which directly emanate from filament 17 towards the window 16, will naturally pass directly from the lamp 10.

The enhancement energy $E_1$ of the emission due to the integration of rays "3" by screen 13 can be represented by the following equation:

$$E_1 = \frac{a(1-E)(1-A)}{[1-a+a(1-E)(1-A)]-[1-a+a(1-E)(1-A)]^2 rt^2} \quad (1)$$

where:

"a" is the filling coefficient of the filament image;

"E" is the filament emissivity;

"A" is the fraction of the total solid angle taken up by the window in the screen through which the beam exists; the losses due to supports and base areas of the lamp have been considered for purposes of this description to be negligible;

"r" is the reflectivity of the mirrored screen surrounding the filament; and

"t" is the transmission of the bulb 11 housing the filament.

Likewise, the reflected rays "2" passing through window 16 will also cause an enhancement in energy "$E_2$" passing from lamp 10, as represented by the following equation:

$$E_2 = 1 + rt^2(131\ a) \quad (2)$$

Therefore, the total enhancement in the energy of emission $E_t$ of the radiation due to the integrating screen 13 is given as:

$$E_t = E_1 + E_2 - 1$$

or $$E_t = rt^2(1-a) + \frac{a(1-E)(1-A)}{[1-a+a(1-E)(1-A)]-[1-a+a(1-E)(1-A)]^2 rt^2} \quad (3)$$

The value of the energy enhancement using theoretical values of: a=0.5; E=0.25; A=0.2; r=0.95; and t=0.92; will be:

$$E_t = 2.45$$

The real increase in radiance will be less than the theoretical increase due to the fact that some of the reflected radiation will be absorbed by the filament 17. However, the absorption of this energy will enhance the thermal efficiency of the bulb 11, allowing the lamp to operate with a lower consumption of power. The decrease in the power consumption also has the added advantage of reducing the generation of unwanted visible light. Visible light or energy of certain wavelengths can also be selectively absorbed or selectively reflected by the screen 13 using various coatings (not shown) in addition to the mirror layer 15.

Figure 2:
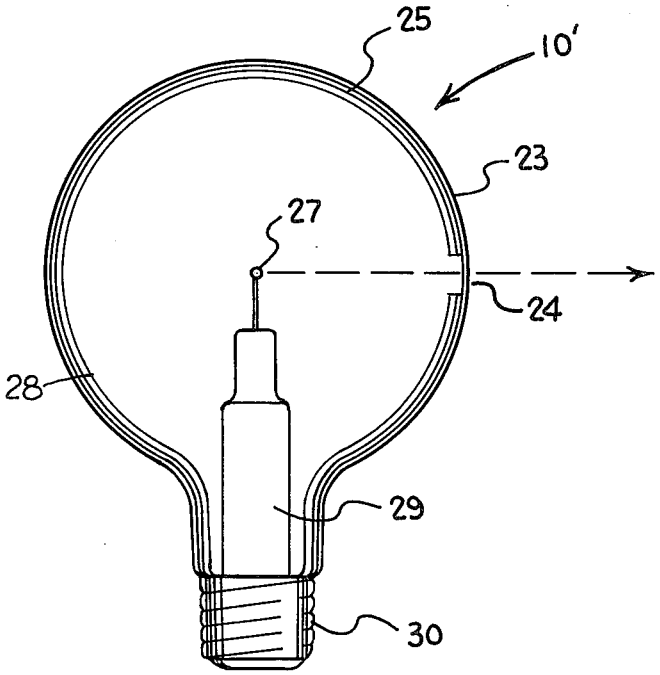
FIG. 2 is a schematic sectional view of a second embodiment of the invention.

Another embodiment of the invention is shown in the schematic sectional view of FIG. 2. In this embodiment, the lamp 10' comprises a filament 27 supported by support 29 anchored in base 30. The filament 27 is centered in a spherical mirrored glass bulb 23 which makes a seal with base 30. A polished reflective layer 25 of silver or gold coats the inner surface of bulb 23 to reflect the radiation back to filament 27, similar to the lamp 10 shown in FIG. 1. Layer 28 can be formed over layer 25 to selectively absorb energy of certain wavelengths, whereby radiation within a given range of wavelengths is reflected back towards the filament.

The bulb 23 has a transparent portion 24 which acts as a window for the radiation being reflected from, and generated by, filament 27.

For this embodiment, there is no transmission loss due to an inner bulb 11 as in FIG. 1, and "t" will now be equal to 1 in equation (3), thus resulting in the following enhancement equation:

$$E_t = r(1-a) + \frac{a(1-E)(1-A)}{[1-a+a(1-E)(1-A)]-[1-a+a(1-E)(1-A)]^2 r} \quad (4)$$

For this equation, the theoretical values will result in an energy:

$E_t = 3.05$

EXAMPLE

A tungsten halogen lamp (General Electric Code 1974) was placed in a 3" diameter specular gold plated sphere. The sphere consisted of two halves, and the port half could be removed without disturbing the lamp. The sphere contained diametrically opposed entrance and exit ports so that the enhancement energy $E_t$ did not include rear reflection fill-in (Energy $E_2$). The image of the lamp filament was transferred by an SF6 slow lens to an observation mask, and the energy was further collected and measured by means of an Eppley thermopile. To standardize lamp temperature, the lamp voltage was adjusted until the voltage current ratio indicated uniform filament resistance.

Table I below contains measurements using the aforementioned apparatus with and without the front half of the sphere being in place:

TABLE I

| | 1. With the front of the sphere removed: | | | | |
|---|---|---|---|---|---|
| | Voltage | Current | Resistance | Power | Thermopile Output |
| Reflector Defocused | 5.9 Volts | 3.22 Amps | 1.83 Ohms | 19 Watts | 1.7 mv |
| Reflector Focused | 5.75 | 3.14 | 1.83 | 18.1 | 1.8 |
| | 2. With the front of the sphere set in place: | | | | |
| | Voltage | Current | Resistance | Power | Thermopile Output |
| | 5.25 | 2.86 | 1.836 | 15 | 2.3 |

By reflecting the rear hemisphere energy back to the bulb, an enhancement of emitted energy of 5.8% was observed accompanying a 4.7% reduction in the input power. This implies an 11% improvement in lamp efficiency with the first configuration.

By reflecting energy back to the bulb through the entire sphere (second configuration), an enhancement of emitted energy of 35% was observed accompanying a 21% reduction in the input power. This implies a 71% improvement in lamp efficiency for this second configuration.

The gain available in this test was limited by the poor glass quality of the G.E. 1974 lamp and the large area subtended by the lamp base, as well as the fact that the segment of the sphere directly behind the filament was not available for additional gain.

Naturally, each lamp of FIGS. 1 and 2 requires that the filament be in a vacuum or surrounded by an inert gas to prevent oxidation of the filament.

Thus, bulb 11 will be evacuated in FIG. 1, and bulb 23 will be evacuated in FIG. 2.

Materials mentioned herein are exemplary and are used only for the purpose of describing the invention. Other materials will naturally occur to the skilled practitioner.

Having thus described the invention, what is desired to be protected by Letters Patent is presented by the appended claims.

What is claimed is:

1. An improved radiation generating lamp operating in the near infrared to infrared range, comprising:

spherical reflective means, said reflective means defining a window; and an incandescent source of radiation centered within said reflective means for generating radiation in the visible range and in the near infrared to infrared range;

said reflective means receiving said radiation emanating from said source and reflecting back to said source at least a portion of said radiation in the visible range and in the infrared and near infrared range, said source absorbing at least a portion of said reflected radiation in the visible range and re-directing at least a portion of said reflected radiation in the near infrared range to infrared range through said window, such as to enhance the emission characteristics of said lamp in the near infrared to infrared range.

2. The improved radiation generating lamp of claim 1, wherein said incandescent source comprises a filament bulb and said reflective means comprises a screen having a mirrored inner surface except for said window, said screen substantially surrounding said filament bulb.

3. The improved radiation generating lamp of claim 2, further comprising means surrounding said filament bulb for selectively absorbing energy within a given range of wavelengths.

4. The improved radiation generating lamp of claim 2, further comprising means surrounding said filament bulb for selectively reflecting energy within a given range of wavelengths.

5. The improved radiation generating lamp of claim 2, wherein said filament bulb and said reflective surface are substantially spherical, said filament bulb being disposed substantially concentrically within said reflective surface.

6. The improved radiation generating lamp of claim 1, wherein said incandescent source of radiation comprises a filament, and said reflective means comprises a bulb housing said filament and having a mirrored inner surface except for said window.

7. The improved radiation generating lamp of claim 6, wherein said bulb comprises means for selectively absorbing energy within a given range of wavelengths.

8. The improved radiation generating lamp of claim 6, wherein said bulb comprises means for selectively reflecting energy within a given range of wavelengths.

9. The improved radiation generating lamp of claim 1, wherein the total energy enhancement $E_t$ of the radiation passing through said window is given by the following equation:

$$E_t = rt^2(1-a) + \frac{a(1-E)(1-A)}{[1-a+a(1-E)(1-A)-[1-a+a(1-E)(1-A)]^2 rt^2}$$

where

"r" is the reflectivity of a reflector surrounding said filament;

"t" is the transmission of a bulb housing said filament;

"A" is the fraction of the total solid angle taken up by the window through which the beam exits;

"a" is the filling factor of the filament; and

"e" is the filament emissivity.

10. The improved radiation generating lamp of claim 1, wherein said reflective means comprises a bulb housing a filament and having a mirrored inner surface defining said window, and wherein "t" is equal to "1" and said total energy enhancement $E_t$ is expressed as:

$$E_t = r(1 - a) + \frac{a(1 - E)(1 - A)}{[1 - a + a(1 - E)(1 - A)] - [1 - a + a(1 - E)(1 - A)]^2 r}$$

11. The improved radiation generating lamp of claim 2, wherein said filament bulb comprises a tungsten filament.

12. A method of increasing the efficiency of a radiation generating lamp in the near infrared to infrared range, said lamp comprising a filament centrally disposed within a spherical reflector, said reflector defining a window to emit radiation, said method comprising the steps of:

(a) energizing said filament to generate radiation in the visible range and in the near infrared to infrared range;

(b) reflecting at least a portion of said radiation in the visible range and in the infrared and near infrared range back toward and onto said filament, whereby at least a portion of said reflected radiation in the visible range is absorbed by said filament and at least a portion of said reflected radiation in the near infrared to infrared range is re-directed from said filament and passes through said window, such as to enhance the emission characteristics of said lamp in the near infrared to infrared range.

13. An incandescent metallic filament lamp for use in the near infrared to infrared range, said lamp comprising a spherical mirrored reflector and a filament substantially centered within said reflector, said reflector reflecting radiation emanating from said filament back to said filament, said filament generating radiation in the visible range and in the near infrared and infrared range and, further, receiving and absorbing at least a portion of said radiation in the visible range and receiving and re-directing a substantial portion of radiation in the near infrared and infrared range, and a window defined in said reflector to pass radiation which is generated by and reflected from said filament, whereby the radiance of said filament in the near infrared to infrared range is increased.

* * * * *